US006978976B2

(12) United States Patent
Duquette et al.

(10) Patent No.: US 6,978,976 B2
(45) Date of Patent: Dec. 27, 2005

(54) MAGNETIZED CORE WITH PNEUMATIC RELEASE SYSTEM FOR CREATING A WAX MOLD FOR A GOLF CLUB HEAD

(75) Inventors: Maurice Duquette, Escondido, CA (US); Broadus Perry Wall, Jr., Carlsbad, CA (US); Brent Anderson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 402 days.

(21) Appl. No.: 10/248,072

(22) Filed: Dec. 16, 2002

(65) Prior Publication Data

US 2003/0139220 A1 Jul. 24, 2003

Related U.S. Application Data

(63) Continuation-in-part of application No. 60/343,982, filed on Dec. 26, 2001.

(51) Int. Cl.[7] ..... B28B 7/28

(52) U.S. Cl. ..... 249/176; 249/177; 249/184; 425/186; 425/192 R

(58) Field of Search ..... 425/190, 192 R, 425/186, 183; 249/183, 184, 186, 175, 177

(56) References Cited

U.S. PATENT DOCUMENTS

| | | | | |
|---|---|---|---|---|
| 3,216,072 | A * | 11/1965 | Bauer | 164/46 |
| 4,541,605 | A * | 9/1985 | Kubota et al. | 249/142 |
| 4,660,801 | A * | 4/1987 | Schad | 249/66.1 |
| 4,993,475 | A * | 2/1991 | Yamada | 164/340 |
| 5,204,046 | A | 4/1993 | Schmidt | 264/328.1 |
| 5,417,559 | A | 5/1995 | Schmidt | 425/186 |
| 5,524,331 | A | 6/1996 | Pond | 29/527.4 |
| 5,547,630 | A | 8/1996 | Schmidt | 473/345 |
| 5,577,550 | A | 11/1996 | Schmidt | 264/297.2 |
| 5,669,828 | A | 9/1997 | Schmidt | 164/516 |
| 5,902,643 | A * | 5/1999 | Carlblom et al. | 427/341 |
| 6,019,587 | A * | 2/2000 | Takahashi et al. | 425/3 |
| 6,406,654 | B1 * | 6/2002 | Perez et al. | 425/186 |

* cited by examiner

*Primary Examiner*—Duane Smith
*Assistant Examiner*—Emmanuel S. Luk
(74) *Attorney, Agent, or Firm*—Michael A. Catania; Elaine H. Lo

(57) ABSTRACT

An improved core for creating wax patterns of golf club heads is disclosed herein. The core includes a center core piece and several outer core pieces removably coupled to the center core piece by magnets embedded in each of the core pieces. The core further includes a pneumatic release system, including a manifold, to easily separate the center core piece from the outer core pieces and expel the center core piece from a wax pattern, thereby eliminating the need to pry and pull pieces out with a tool, which could damage the wax pattern of the golf club head.

4 Claims, 3 Drawing Sheets

FIG. 3
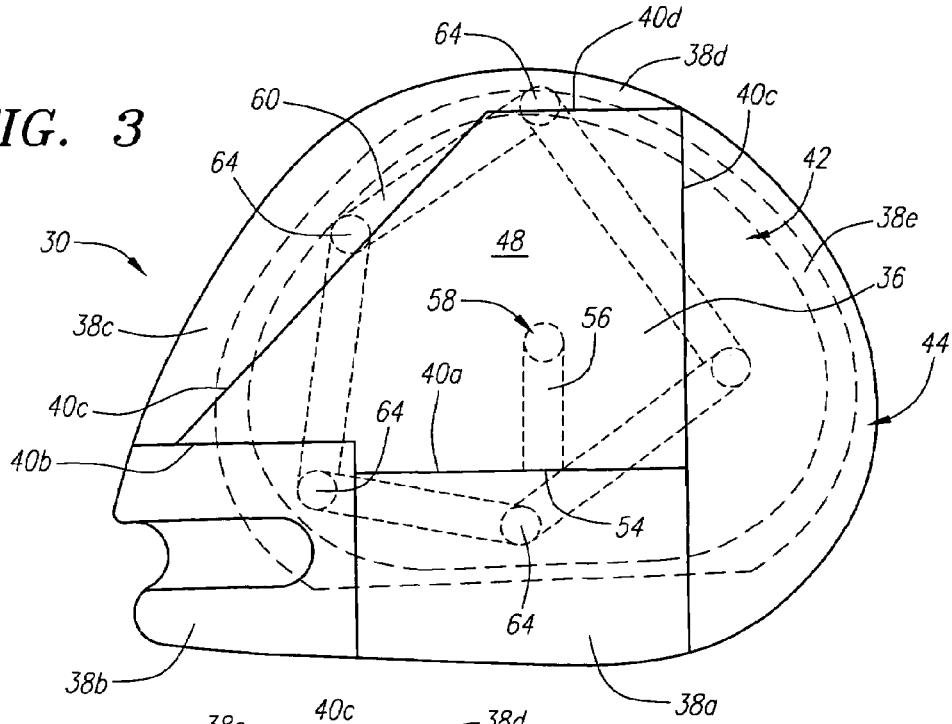
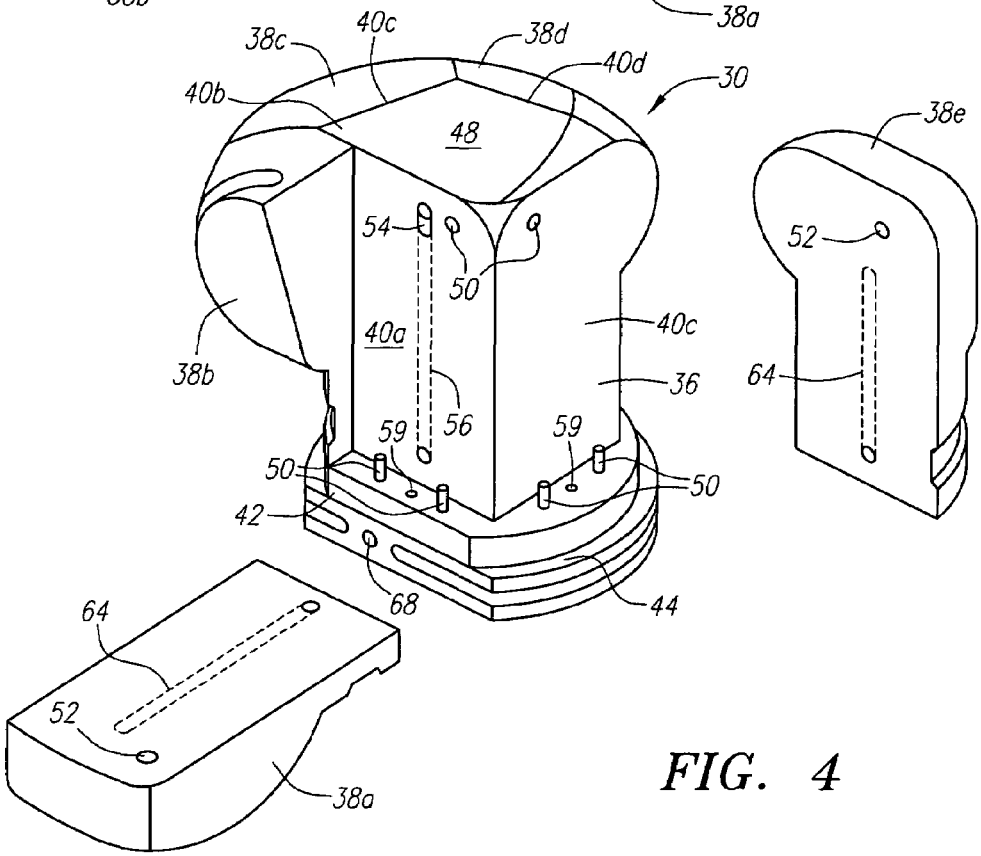
FIG. 4

MAGNETIZED CORE WITH PNEUMATIC RELEASE SYSTEM FOR CREATING A WAX MOLD FOR A GOLF CLUB HEAD

CROSS REFERENCE TO RELATED APPLICATIONS

This application is a continuation-in-part of U.S. patent application Ser. No. 60/343,982, filed on Dec. 26, 2001.

FEDERAL RESEARCH STATEMENT

[Not Applicable]

BACKGROUND OF INVENTION

1. Field of the Invention

The present invention relates to investment cast molding tools for the manufacture of golf club heads. More specifically, the present invention relates to an investment cast molding apparatus for the construction of metal wood-type golf club heads.

2. Description of the Related Art

One of the oldest methods of forming golf club heads is through investment casting. This process is currently used to produce the majority of wood-type golf club heads. In this process, a resin mold, which includes two plates composed of aluminum hinged at one end and having a hollow center, is used. A master copy of the golf club head to be produced is suspended in the hollow center and a liquid resin is poured around the master copy to create the outer shape of the golf club head upon solidification of the resin.

In hollow metal wood-type golf club heads, the interior shape of the golf club head is produced by an aluminum core, which typically consists of five pieces. Wax is injected into the mold to fill the space between the inner and outer shapes of the golf club head. The mold is opened and the aluminum core with the wax pattern around it is removed. The aluminum core is separated from the wax pattern by first removing a center piece of the core. The remaining pieces of the core may then be shifted around and removed through the opening that was created by removal of the center core piece. When all of the pieces of the core have been removed, the wax pattern of the golf club head will have a large hole in the either crown or sole, through which the aluminum core was removed. This hole will be covered by a plate, which is typically welded about its perimeter to the golf club head. The weld is then sanded smooth to blend with the rest of the golf club head.

There are several areas with this apparatus and manufacturing process that could be improved. First, the removal of the core from the wax pattern and mold can be time-consuming and laborious. Typically, a tool is inserted into openings formed in the base of the core and used to pry the individual core pieces from the wax pattern and mold. The tool may slip and can damage the core, wax pattern and/or the mold. Second, extraction of the first core piece from the mold can create a suction force on the wax pattern, drawing the wax pattern away from the mold and damaging it. Third, the individual core pieces, which are designed to slide in a longitudinal direction with respect to each other so as to enable their removal from the wax pattern, lack a means for restricting movement in the longitudinal direction during insertion of the core into the cavity of the mold. Thus, as the core is being placed in the mold cavity, individual core pieces can slide relative to the others and damage either themselves or the mold.

Thus, there is a need for an improved aluminum core that stays together during insertion of the core in a mold and is easy to remove from a wax mold.

SUMMARY OF INVENTION

The present invention is an improved core for producing hollow wax patterns of golf club heads. The improved core includes a center core piece and a plurality of outer core pieces. Each of the outer core pieces is removably coupled to a respective side wall of the center core piece. Magnets embedded in each of the core pieces secure the various core pieces together. The improved core further includes a pneumatic release system to easily separate the center core piece from the outer core pieces and expel the center core piece from the wax mold. The pneumatic release system eliminates the need to pry and pull pieces out with a tool, which could damage the wax pattern of the golf club head.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF DRAWINGS

FIG. 3 is a top plan view of the core of FIG. 2.

FIG. 4 is a partial exploded perspective view of the core of FIG. 2.

DETAILED DESCRIPTION

The present invention is directed to an apparatus and a method for producing hollow wax patterns of golf club heads, and more particularly a hollow metallic wood-type golf club head. The improved core of the present invention has magnets embedded in each of the core pieces to secure the individual core pieces together. The core further includes a pneumatic release system for separating the center core piece from the outer core pieces and expelling the center core piece from a wax mold, without the use of a prying tool and without damage to the wax pattern.

Figure 1:
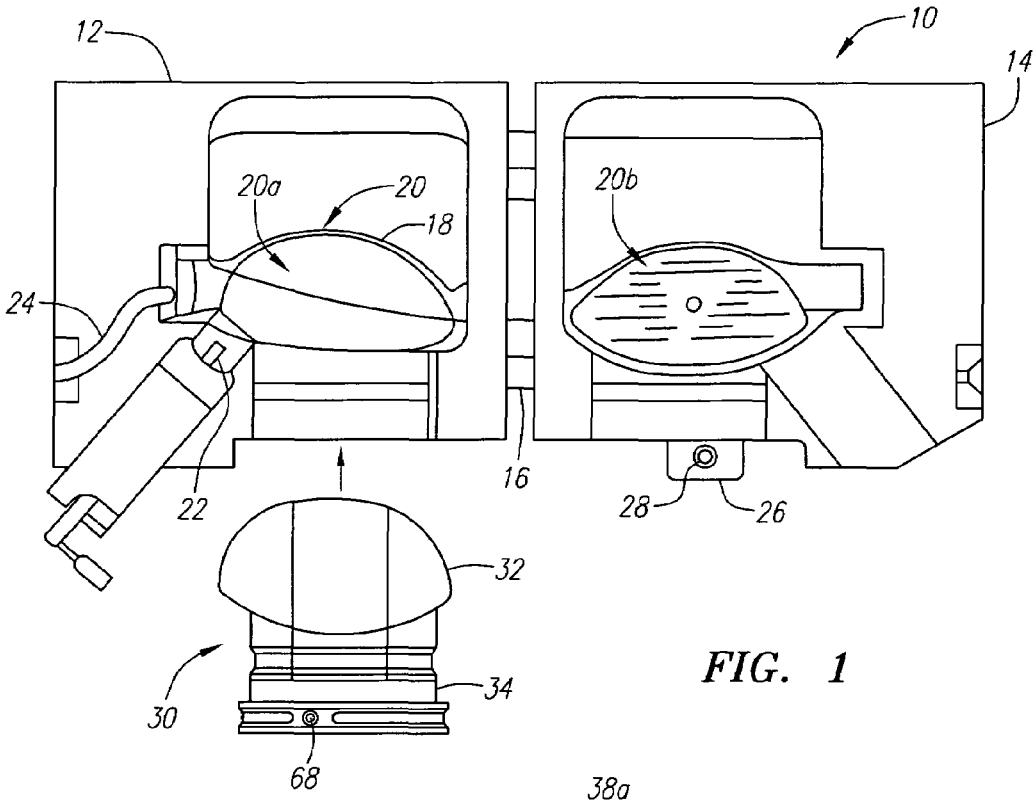
FIG. 1 is a top plan view of an apparatus and a core for forming a golf club head in accordance with the present invention.

FIG. 1 illustrates an apparatus 10 for forming a golf club head in accordance with the present invention. Apparatus 10 includes a first half 12 and a second half 14, which are coupled together by a hinge 16. First and second halves 12 and 14 make up a mold 18 that has a mold cavity 20, one portion 20*a* of which is formed in first half 12, and another portion 22*b* of which is formed in second half 14. When the two halves 12 and 14 of apparatus 10 are brought together in a closed position, portions 20*a* and 20*b* register together to form a single, complete mold cavity 20.

Mold cavity 20 has a shape generally complementary to the exterior of the desired golf club head, with cavity portion 20*a* forming a majority of the club head exterior, and cavity portion 20*b* forming the a front portion of the club head. Apparatus 10 includes a telescoping insert pin 22 for forming the space in the golf club head that will later be occupied by a golf club shaft.

Mold cavity 20 is designed to receive a core 30. As will be described in greater detail below, core 30 is comprised of multiple of core pieces. Core 30 has an upper portion 32 that is generally identical in size and shape to an interior of the golf club head. Core 30 further includes a lower portion 34 that extends from mold cavity 20 of apparatus 10, when core 30 is placed in mold 18.

Apparatus 10 further includes a supply duct 24 for directing injected wax into mold cavity 20 and around core 30. In addition, apparatus 10 includes a spring lock 26 mounted on second half 14. Spring lock 26 includes a retractable locking pin 28 that engages an aperture in core 30 to firmly fix the core 30 in mold cavity 20. Additional information about wax molding methods and articles for manufacturing golf club heads is disclosed in U.S. Pat. Nos. 5,547,360, 5,577,550, 5,204,046, 5,669,828 and 5,417,559, all of which are hereby incorporated by reference in their entirety.

Figure 2:
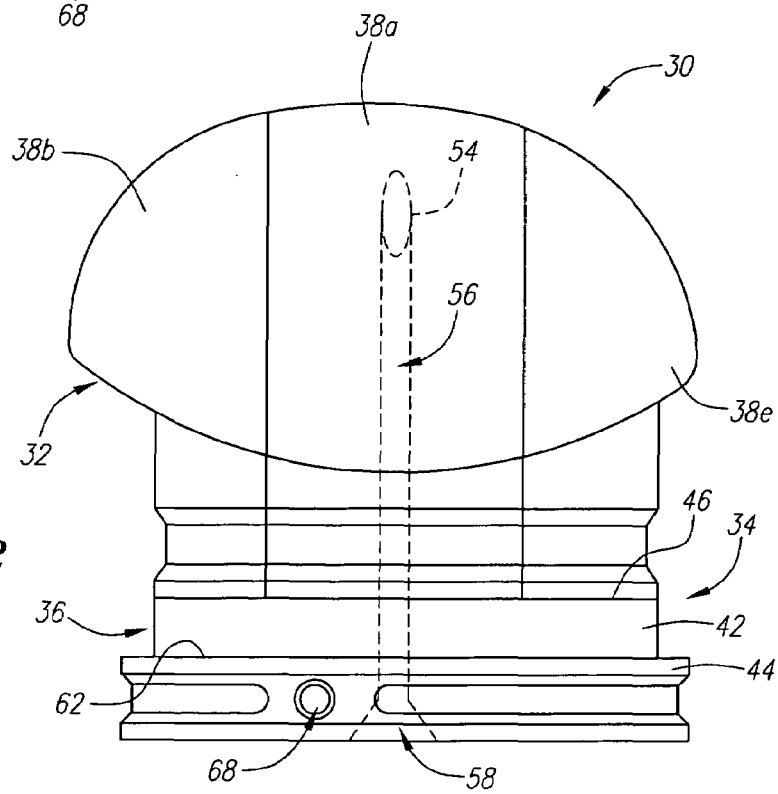
FIG. 2 is a front plan view of the core shown in FIG. 1.

FIGS. 2–4 illustrate core 30 in greater detail. Core 30 is preferably made of a metal, such as aluminum. Core 30 includes a center core piece 36 and outer core pieces 38*a*–38*e*. Each outer core piece 38*a*–38*e* has a planar surface that is flush with a respective planar side wall 40*a*–40*e* of center core piece 36. Although five outer core pieces 38*a*–38*e* are depicted in the drawings, one of ordinary skill in the art will appreciate that core 30 may have fewer than or greater than five outer core pieces as well.

Center core piece 36 includes a base 42 and a manifold 44. Base 42 has a generally planar upper surface 46, from which side walls 40*a*–40*e* extend upward to a top surface 48 of center core piece 36. Top surface 48 of center core piece 36 forms a portion of an interior wall of the golf club head. Pins 50 project from upper surface 46 of base 42 and are received in respective openings (not shown) formed in outer core pieces 38*a*–38*e*. Pins 50 align outer core pieces 38*a*–38*e* with respect to center core piece 36 and restrict the movement of outer core pieces 38*a*–38*e* relative to center core piece 36 to a single direction.

Center core piece 36 further includes a magnet 50 embedded in each side wall 40*a*–40*e* thereof. Magnets 50 are preferably located proximate top surface 48 of center core piece 36, however, one of ordinary skill in the art will appreciate that magnets 50 may be located at other suitable locations along side walls 40*a*–40*e*. Each side wall 40*a*–40*e* may further include more than one magnet 50. A magnet 52 is embedded in the planar surface of each outer core piece 38*a*–38*e* at a corresponding location. Magnets 50 and 52 removably secure outer core pieces 38*a*–38*e* to center core piece 36. Each magnet 50 is flush with a respective side wall 40*a*–40*e* of center core piece 36. Similarly, each magnet 52 is flush with the planar surface of the outer core piece 38*a*–38*e*. Thus, outer core pieces 38*a*–38*e* may be slid along the respective side wall 40*a*–40*e* of center core piece 36 without any interference from magnets 50 and 52. Magnets 50 and 52 prevent unwanted movement of outer core pieces 38*a*–38*e* with respect to center core piece 36, such as during insertion of core 30 into cavity 20 of apparatus 10. Without magnets 50 and 52, outer core pieces 38*a*–38*e* may separate from center core piece 36 and damage either themselves or mold 18.

One side wall 40*a* of center core piece 36 has an opening 54 formed therein. Opening 54 is located near top surface 48 of center core piece 36. Opening 54 leads to a passage 56 that extends through base 42 and manifold 44 of center core piece 36. Passage 54 and opening 56 are part of the pneumatic release system for expelling center core piece 36 from a wax pattern.

Figure 5:
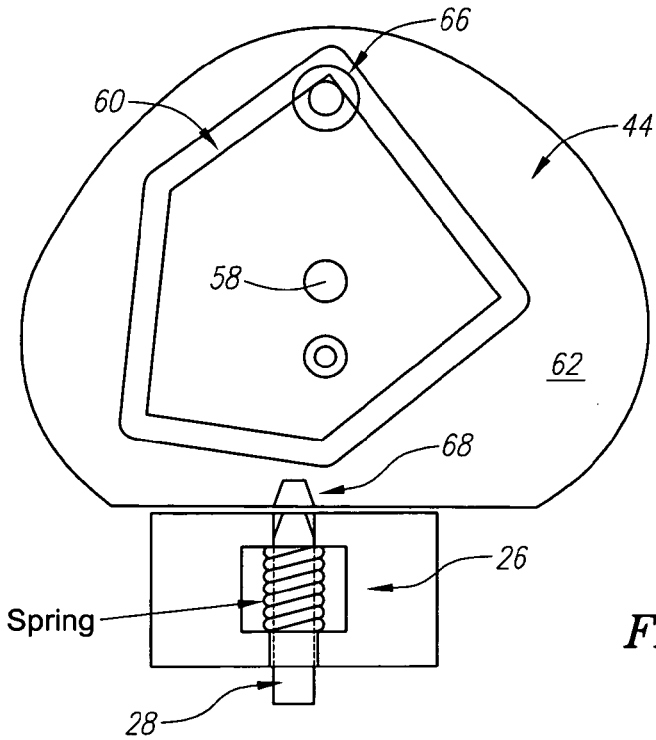
FIG. 5 is a top plan view of the manifold of the core of FIG. 2.

Manifold 44, which is attached to base 42 of center core piece 36, completes the pneumatic release system. Manifold 44 has an opening 58 that is aligned with passage 54 in base 42. As illustrated in FIG. 5, manifold 44 further includes a groove 60 formed in an upper surface 62 of manifold 44. Groove 60 connects a chamber 64 formed in each of the outer core pieces 38*a*–38*e*, through additional openings 59 formed in base 42, to a vent hole 66.

Manifold 44 also helps to position and align core 30 in mold cavity 20. Manifold 44 includes an aperture 68 for receiving retractable locking pin 28 of spring lock 26 to secure core 30 in mold cavity 20. Thus, when core 30 is placed in mold cavity portion 20*a* and apparatus 10 is closed, the locking pin 28 of spring lock 26 engages aperture 68 in manifold 44 to positively lock core 30 in place (FIG. 5).

Figure 6:
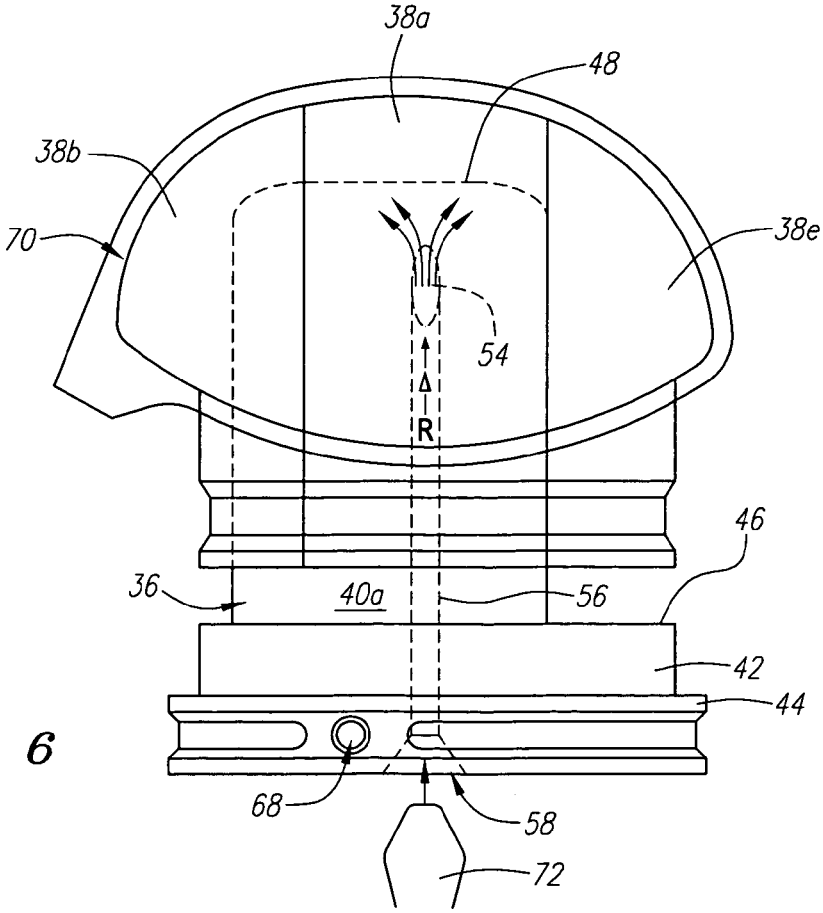
FIG. 6 illustrates a center piece of the core of FIG. 2 being expelled from a wax pattern.

With core 30 secured in mold cavity 20 of apparatus 10, wax is introduced to supply duct 24 and injected into mold cavity 20. The wax encases top portion 32 of core 30 and forms a wax pattern 70 of a hollow golf club head. FIG. 6 illustrates wax pattern 70 formed about top portion 32 of core 30. When wax pattern 70 has cooled, it may then be removed from apparatus 10. To remove wax pattern 70, apparatus 10 is opened, and pin 28 of spring lock 26 on second half 14 of apparatus 10 is retracted from aperture 68 in manifold 44, thereby releasing core 30 from its fixed position in apparatus 10.

A source 72 of pressurized gas, such as compressed air, is then supplied to opening 58 in manifold 44 of core 30. The pressurized gas travels through passage 56 in center core piece 36 and out opening 54 in side wall 40*a*. The pressurized gas travels upward, compressing between wax pattern 70 and top surface 48 of center core piece 36. This compressive force is sufficient to overcome the magnetic forces holding center core piece 36 and outer core pieces 38*a*–38*e* together, and center core piece 36 is pushed out of wax pattern 70 and mold cavity 20. Pressurized gas also enters chambers 64 in outer core pieces 38*a*–38*e* to maintain outer core pieces 38*a*–38*e* in wax pattern 70 as center core piece 36 is expelled. Excess gas and any vacuum or suction created by expulsion of the center core piece 36 is released through vent hole 66, making the removal of center core piece 36 easy.

After center core piece 36 has been expelled, outer core pieces 38*a*–38*e* may be individually removed through the opening in wax pattern 70 created by center core piece 36 and directly reassembled onto center core piece 36, so that core 30 is ready for use.

The unencumbered wax pattern 70 may then be removed from mold cavity 20 of apparatus 20. A golf club head is then formed as discussed in U.S. Pat. No. 5,577,550. The club head is typically formed of titanium, steel, titanium alloys, steel alloys, amorphous metals and the like, and can vary in size from 150 cc to 500 cc, more preferably 250 cc to 385 cc, and most preferably 335 cc.

From the foregoing it is believed that those skilled in the pertinent art will recognize the meritorious advancement of this invention and will readily understand that while the present invention has been described in association with a preferred embodiment thereof illustrated in the accompanying drawings, numerous changes, modifications and substitutions of equivalents may be made therein without departing from the spirit and scope of this invention, which is intended to be unlimited by the foregoing except as may appear in the following appended claims. Therefore, the embodiments of the present invention in which an exclusive property or privilege is claimed are defined in the following appended claims.

We claim as our invention:

1. A combination for use in a wax pattern molding process comprising:

a mold having a cavity formed therein, the mold having a spring-loaded lock, said spring-loaded lock having a retractable pin; and a core removably inserted into the cavity of the mold, the core including:

a center core piece including a base and a plurality of side walls, the base having a passage formed therein, the passage extending from the base to one of the side walls of the center core piece;

a plurality of outer core pieces, each outer core piece being removably coupled to a respective side wall of the center core piece and having a chamber formed therein; and a manifold coupled to the base of the center core piece, the manifold having an opening in flow communication with the passage of the center core piece, and a groove formed therein, the groove being in flow communication with the chambers of the outer core pieces and a vent hole, the manifold having an aperture formed in a side thereof;

wherein the retractable pin extends into the aperture to secure the core in the mold.

2. The combination according to claim 1, wherein each of the center core piece and the outer core pieces has at least one magnet embedded therein, the magnets securing each of the outer core pieces to the respective side wall of the center core piece.

3. The combination according to claim 1, wherein the passage in the center core piece extends from the base to one of the side walls proximate a top surface of the center core piece.

4. The combination according to claim 1, wherein the base of the center core piece includes a plurality of pins projecting upward from the base, and wherein each outer core piece has at least one opening formed in a bottom surface thereof for receiving a respective pin, thereby aligning the outer core piece with respect to the center core piece.

* * * * *